US008158322B2

(12) United States Patent
Nakatani

(10) Patent No.: US 8,158,322 B2
(45) Date of Patent: Apr. 17, 2012

(54) TONER

(75) Inventor: Hiroshi Nakatani, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 12/828,867

(22) Filed: Jul. 1, 2010

(65) Prior Publication Data

US 2010/0266950 A1 Oct. 21, 2010

Related U.S. Application Data

(62) Division of application No. 10/570,151, filed as application No. PCT/JP2004/008202 on Jun. 11, 2004, now Pat. No. 7,846,632.

(30) Foreign Application Priority Data

Sep. 3, 2003 (JP) ..... 2003-311008

(51) Int. Cl.
*G03G 9/113* (2006.01)

(52) U.S. Cl. ..... 430/137.11; 430/108.6; 430/108.7

(58) Field of Classification Search ..... 430/108.7, 430/108.6, 137.11
See application file for complete search history.

(56) References Cited

U.S. PATENT DOCUMENTS

| | | | | |
|---|---|---|---|---|
| 5,776,646 | A * | 7/1998 | Hagi et al. | 430/108.6 |
| 5,827,632 | A | 10/1998 | Inaba et al. | |
| 2003/0027070 | A1 | 2/2003 | Niwa | |
| 2003/0152506 | A1 * | 8/2003 | Shibasaki et al. | 423/335 |
| 2004/0043315 | A1 * | 3/2004 | Takiguchi et al. | 430/108.6 |

FOREIGN PATENT DOCUMENTS

| | | | |
|---|---|---|---|
| JP | 5-224456 | A | 9/1993 |
| JP | 10-83096 | A | 3/1998 |
| JP | 11-44968 | A | 2/1999 |
| JP | 11-174731 | A | 7/1999 |
| JP | 11-184165 | A | 7/1999 |
| JP | 11-288129 | A | 10/1999 |
| JP | 2000-66440 | A | 3/2000 |
| JP | 2000-187358 | A | 7/2000 |
| JP | 2000-194161 | A | 7/2000 |
| JP | 2000-258947 | A | 9/2000 |
| JP | 2000-281918 | A | 10/2000 |
| JP | 2001-60036 | A | 3/2001 |
| JP | 2001-281911 | A | 10/2001 |
| JP | 2002-154820 | A | 5/2002 |
| JP | 2002-182423 | * | 6/2002 |
| JP | 2002-182423 | A | 6/2002 |
| JP | 2002-244340 | A | 8/2002 |
| JP | 2002-278143 | A | 9/2002 |
| JP | 2002-318467 | A | 10/2002 |
| JP | 2003-029450 | * | 1/2003 |
| JP | 2003-29450 | A | 1/2003 |
| JP | 2004-102236 | A | 4/2004 |

OTHER PUBLICATIONS

Translation of JP 2002-182423, published Jun. 2002.*
Translation of JP 2003-029450, published Jan. 2003.*

* cited by examiner

*Primary Examiner* — Peter Vajda
(74) *Attorney, Agent, or Firm* — Westerman, Hattori, Daniels & Adrian, LLP

(57) ABSTRACT

The toner of the present invention, comprising a colored resin particle and an external additive, wherein said external additive contains a silica fine particle (A) having a Dv50/Dv10 of 1.8 or more, in which Dv10 represents a particle diameter at which a volume cumulative total from small particle diameter side is 10% and Dv50 represents a particle diameter at which the mentioned volume cumulative total is 50%, a volume average particle diameter in the range from 0.1 to 1.0 μ, and a sphericity in the range from 1 to 1.3. The toner of the present invention cause less fog, and excellent resolution on the printed image, excellent in cleaning property, and cause less filming.

4 Claims, No Drawings

TONER

CROSS-REFERENCE TO RELATED APPLICATIONS

This application is a divisional of U.S. patent application Ser. No. 10/570,151 filed Mar. 1, 2006 which is a 371 of PCT/JP04/08202 filed Jun. 11, 2004.

TECHNICAL FIELD

The present invention relates to a toner for developing an electrostatic latent image formed by an electrophotographic process, electrostatic recording process and the like, and in particular, to a toner, less likely to cause fog and excellent cleaning properties.

BACKGROUND ART

In an image forming apparatus such as an electrophotographic apparatus and electrostatic recording apparatus, an electrostatic latent image formed on a photoconductive member is first developed with a toner. After the toner image formed is then transferred to a transfer medium such as paper or OHP film, the transferred toner image is fixed thereto by any of various methods such as heating, pressing and use of solvent vapor.

On the transfer process, since the toner partly remains on the photoconductive member, it is necessary to remove the residual toner from the photoconductive member. A cleaning process for removing the residual toner from the photoconductive member after the transfer process includes a developing-spontaneously cleaning method (a cleaner-less method) for removing the residual toner on the photoconductive member without using a cleaning device, and another cleaning method using a cleaning device such as a cleaning blade and the like. And, such the image forming apparatus has mainly employed a pulverized toner which is produced in such a manner that a thermoplastic resin including a colorant, a charge control agent and the like is melt-blended for uniform dispersion and then the dispersion is subjected to pulverizing and classification.

Currently, the image forming apparatus is becoming more and more advanced and thus achievement of high speed as well as high resolution by a method of forming an electrostatic latent image by a laser is demanded. Accordingly, in addition to achieving a small particle diameter and a sharp particle diameter distribution for responding to the high resolution requirement, toners are required to have low-temperature fixing ability so as to correspond with high-printing speed model printers. However, the above-mentioned method for producing a pulverized toner has a difficulty for producing a toner having a particle diameter of about 5 to 6 μm or less and a limitation for designing a particle size distribution narrow at the classification process.

In order to solve such the problems, a toner producing method using a polymerization method has been proposed. The toners produced by the polymerization method are excellent in flowability and transferring ability for transferring onto a transfer medium. However, the polymerized toner adheres to a photoconductive member with a large adhesion force, so that the polymerized toner is easily passed through a space between the photoconductive member and the cleaning blade, thereby to cause cleaning failure.

Accordingly, generally, an additive referred to as an external additive is externally added to the surface of the colored resin particle. For the external additive, an inorganic fine particle is used typically.

For instance, Japanese Patent Application Laid-Open Hei 5-224456 discloses a developer comprising a toner for developing an electrostatic latent image including at least a binder resin and a colorant, and a spherical silica particle produced by a deflagration method. The literature shows that the developer is excellent in flowability, cleaning properties and the like. However, the toner disclosed in the literature causes lowering of cleaning properties due to printing over a long period of time, resulting in contamination of a photoconductive member and generation of fog on printed image.

Japanese Patent Application Laid-Open 2001-281911 proposed by the inventers of the present invention discloses a toner including an organic fine particle and an inorganic fine particle each having an average particle diameter and a sphericity within a specific range, respectively. And, Japanese Patent Application Laid-Open 2001-281918 proposed by the inventors discloses a toner including a silicate compound having a degree of hydrophobicity, a number average particle diameter and a sphericity within a specific range, respectively. The toners in both literatures can provide an image having high image density without fog and blur even if recycled papers are used. Beside that, a toner causing less fog and improved in cleaning properties are required.

Japanese Patent Application Laid-Open 2002-318467 discloses a toner to which an external additive is added, in which the external additive comprises a fine particle charged with an opposite polarity of the toner and having a particle diameter within a specific range, a monodisperse spherical silica having a gravity and a particle diameter within a specific range, respectively, and an organic compound having a diameter smaller than the monodisperse spherical silica. The literature further discloses that an image forming apparatus using the disclosed toner does not cause degradation of image quality and can prevent cleaning failure. However, since a toner comes to be used under a high-temperature and humidity condition recently, a toner causing less fog and improved in cleaning properties even under various humidity and temperature conditions is required.

Published Patent literature 1: Japanese Patent Application Laid-open Hei 5-224456, Published Patent literature 2: Japanese Patent Application Laid-open 2001-284911, Published Patent literature 3: Japanese Patent Application Laid-open 2001-281918, Published Patent literature 4: Japanese Patent Application Laid-open 2002-318467.

Accordingly, the object of the present invention is to provide a toner, causing less fog and having excellent cleaning properties.

DISCLOSURE OF THE INVENTION

The inventor of the present invention carried out an in-depth study to accomplish the object. As a result, he has found this object can be accomplished by using a toner comprising a colored resin particle and an external additive, in which the external additive comprises a silica fine particle having a wide particle diameter distribution.

The present invention has been accomplished based on the above finding and provide a toner comprising a colored resin particle and an external additive, wherein said external additive comprises a silica fine particle (A) having a Dv50/Dv10 of 1.8 or more, in which Dv10 represents a particle diameter at which a volume cumulative total from small particle diameter side is 10% and Dv50 represents a particle diameter at which the mentioned volume cumulative total is 50%, a volume average particle diameter in the range from 0.1 to 1.0 μm or more, and a sphericity in the range from 1 to 1.3.

Using the toner makes it possible to improve cleaning properties and thus lower generation of fog on printed image.

In the present invention, the silica fine particle (A) preferably has an appearance bulk density in the range from 50 to 250 g/l.

And, in the present invention, the silica fine particle (A) is preferably produced by a melting method.

Furthermore, in the present invention, the external additive preferably further comprises a silica fine particle (B) having a volume average diameter in the range from 5 to 80 nm.

And, the external additive preferably further comprises a conductive inorganic particle (C) having a volume average diameter in the range from 0.01 to 1 μm.

EFFECT OF THE INVENTION

According to the present invention, a toner providing less fog and excellent resolution on printed image and having excellent cleaning properties, additionally causing less filming, can be provided.

BEST MODE FOR CARRYING OUT THE INVENTION

A toner according to the present invention is described in detail below.

A toner of the present invention comprises a colored resin particles and an external additive. In the present invention, the external additive typically adheres to the colored resin particles or is embedded thereon partially. And, the external additive may be partially isolated from the colored resin particles.

The silica fine particle (A) comprised in the external additive constituting the toner according to the present invention is designed to have a ratio of Dv50 to Dv10 (a Dv50/Dv10) of 1.8 or more, more preferably 2 or more, in which Dv10 represents a particle diameter at which a volume cumulative total from small particle diameter side is 10% and Dv50 represents a particle diameter at which the mentioned volume cumulative total is 50%. If the Dv50/Dv10 is less than 1.8, the resulting toner may be blocked and filming may be generated on the photoconductive member.

The silica fine particle (A) has a volume average diameter in the range from 0.1 to 1 μm, preferably in the range from 0.1 to 0.5 μm. Using the silica fine particle (A) having the above described average diameter leads to the toner excellent in flowability and transferring property.

A method for measuring the particle diameter and the particle diameter distribution of the silica fine particle (A) includes, but is not limited to, a method for dispersing the silica fine particle (A) into water and then measuring the resultant dispersion using a laser type particle diameter measurement apparatus (for example, "MICROTRAC UPA150", Trade, Name, manufactured by NIKKISO Co., Ltd.).

The silica fine particle (A) has preferably a sphericity in the range from 1 to 1.3, more preferably in the range from 1 to 1.2. If the sphericity is larger than 1.3, cleaning properties is lowered and thus fog is generated on printed image.

In the viewpoint for obtaining a spherical toner having a wide particle diameter distribution and having excellent environmental stability, the silica fine particle (A) is preferably produced by a melting method.

And, the silica fine particle (A) has preferably an appearance bulk density in the range from 50 to 250 g/l, more preferably in the range from 80 to 200 g/l. If the appearance bulk density is lower than 50 g/l, filming may be generated on a photoconductive member, on the contrary, if the appearance bulk density is larger than 250 g/l, cleaning properties may be deteriorated and thus cause fog on printed image.

The silica fine particle (A) is preferably produced in such a manner that a silica fine particle is hydrophobicitizing-treated with a treating agent such as silane coupling agent, silicone oil, fatty acid and fatty acid soap. A method of the hydrophobicitizing treatment includes a process for dropping or splaying the aforesaid treating agent to the silica fine particle while stirring the silica fine particle at a high speed, a process for dissolving the aforesaid treating agent in an organic solvent and then adding the silica fine particle to the organic solvent comprising the treating agent while stirring the organic solvent, and the like. In the former process, the treating agent may be diluted with an organic solvent and the like. The silica fine particle (A) preferably has a degree of hydrophobicity in the range from 40 to 95%, wherein the degree of hydrophobicity is measured using a methanol test. If the degree of hydrophobicity is smaller than 40%, the resulting toner is easily influenced by environmental conditions. Especially, under a high temperature and high humidity environmental condition, a charge amount of the toner decreases, causing fog on printed image easily. On the other hand, if the degree of hydrophobicity is larger than 95%, under a low temperature and low humidity condition, a charge amount of the toner increases, causing lowering of an image density.

An amount of the silica fine particle (A) is generally in the range from 0.3 to 5 parts by weight, preferably in the range from 0.5 to 3 parts, per 100 parts by weight of the colored resin particle. If the amount of the silica fine particle (A) is smaller than the aforesaid range, the cleaning property may be deteriorated and flowability of the resulting toner may be lowered. On the other hand, if the amount of the silica fine particle is larger than 5 parts by weight, flowability of the toner may be lowered, resulting in blur on printed image.

In the present invention, the external additive can comprise only the aforesaid silica fine particle (A). More preferably, the external additive further comprises a silica fine particle (B) having a volume average particle diameter in the range from 5 to 80 nm, more preferably in the range from 7 to 30 nm, and a conductive inorganic fine particle (C).

It is preferable to employ the silica fine particle (B) which is hydrophobicitizing treated, well as the aforesaid silica fine particle (A). In this case, the silica fine particle (B) preferably has a degree of hydrophobicity in the range from 40 to 95%. If the degree of hydrophobicity is smaller than 40%, the resulting toner is easily influenced by environmental conditions. Especially, under a high temperature and high humidity condition, a charge amount of the toner decreases, causing fog on printed image easily. On the other hand, if the degree of hydrophobicity is larger than 95%, under a low temperature and low humidity condition, a charge amount of the toner increases, causing lowering of an image density.

An amount of the silica fine particle (B) is preferably in the range from 0.1 to 3 parts by weight, more preferably in the range from 0.3 to 2 parts by weight, per 100 parts by weight of the colored resin particle. If the amount of the silica fine particle (B) is smaller than the aforesaid range, cleaning property of the resulting toner may decrease. On the other hand, if the amount of the silica fine particle (B) is larger than the range, noise and fixing failure may occur under low temperature and low humidity condition.

The conductive inorganic fine particle (C) has a specific resistance in the range of 5000 Ω·cm or below, more preferably in the range from 0.1 to 300 Ω·cm, most preferably in the range from 1 to 200 Ω·cm. If the specific resistance is larger than 500 Ω·cm, a charge amount of the resulting toner may become large, and image density was reduced under low temperature and low humidity condition. On the other hand, if the specific resistance is smaller than 0.1 Ω·cm, a charge amount of the toner may become small, causing fog on printed image under high temperature and high humidity.

As the aforesaid conductive inorganic fine particle (C), there can be mentioned; a tin oxide fine particle, a titanium oxide fine particle surface-treated with tin oxide, a titanium oxide fine particle surface-treated with tin oxide doped with antimony (for instance, "EC-100", "EC-210" and "EC-300", Trade Name, manufactured by Titan Kogyo K.K., "ET300W", "ET500W" and "ET600W", Trade, Name, manufactured by Ishihara Industry Co., Ltd. and "W-P", Trade Name, manufactured by JEMCO Inc.), a titanium oxide fine particle surface-treated with indium oxide doped with antimony (for instance, "EC-500" and "EC-510", Trade Name, manufactured by Titan Kogyo K.K), a aluminum oxide fine particle surface-treated with indium oxide doped with antimony (for instance, "EC-700", Trade Name, manufactured by Titan Kogyo K.K), a silicon oxide fine particle surface-treated with tin oxide doped with antimony (for instance, "EC-650", Trade Name, manufactured by Titan Kogyo K.K), a tin-antimony complex oxide fine particle (for instance, "EC-900", Trade Name, manufactured by Titan Kogyo K.K, "T-1", Trade Name manufactured by JEMCO Inc.), and an indium-tin complex oxide fine particle (for instance, "ITO", Trade Name, manufactured by JEMCO Inc.,).

The aforesaid conductive inorganic fine particle (C) generally has a number average particle diameter in the range from 0.01 to 4 m, more preferably in the range from 0.03 to 1 μm, most preferably in the range from 0.05 to 0.5 μm. The particle diameter having the aforesaid range allows the resulting toner having a suitable charge property even under different conditions.

The conductive inorganic particle (C) is hydrophobicitizing treated with silane coupling agent, higher fatty acid metal salt and the like. The conductive inorganic fine particle (C) preferably has a degree of hydrophobicity in the range from 5 to 90%, more preferably in the range from 10 to 80%, most preferably in the range from 20 to 70%, wherein the degree of hydrophobicity is measured using a methanol test.

An amount of the conductive inorganic fine particle (C) is preferably in the range from 0.05 to 2 parts by weight, more preferably 0.1 to 1 parts by weight, per 100 parts by weight of the colored resin particle. If the amount of the conductive inorganic fine particle (C) is smaller than the aforesaid range, fog is generated on printed image under low temperature and low humidity or high temperature and high humidity condition. On the other hand, if the amount of the conductive inorganic fine particle (C) is larger than the range, the fine particles (C) may be released from the colored resin particle, causing spoiling members inside of a toner cartridge.

In the present invention, the external additive comprises, preferably, the silica fine particle (B) and the conductive inorganic fine particle (C), in addition to the silica fine particle (A). In addition, another external additive, which is used to a conventionally-used toner, may be employed. As the external additive, there can be mentioned; an inorganic fine particle and an organic fine particle, in which the inorganic fine particle includes, for instance, aluminum oxide, titanium oxide, zinc oxide, tin oxide, cerium oxide, silicon nitride, calcium carbonate, calcium phosphate, barium titanate, strontium titanate and the like, and the organic fine particle includes a methacrylic ester polymer particle, a acrylic ester polymer particle, a styrene-methacrylic ester copolymer particle, a styrene-acrylic ester copolymer particle, core-shell structured particles having a core formed of styrene polymer and a shell formed of methacrylic ester polymer, melamine resin particle and the like.

The colored resin particle constituting a toner according to the present invention is a particle comprising at least a binder resin and a colorant, preferably a parting agent and a charge control agent, in addition thereto, and a magnetic material if necessary.

As the examples of the binder resin, there can be mentioned; resins such as polystyrene, styrene-butyl acrylate copolymers, polyester resins and epoxy resins, which are conventionally used for the toner.

As the colorant, any pigments and dyes can be employed, in addition to carbon black, titanium black, magnetic powder, oil black, and titanium white. Carbon black having a primary particle diameter in the range from 20 to 40 nm is preferably used as a black colorant. The particle diameter within this range is preferred because such carbon black can be uniformly dispersed in the toner and fog in printed image developed using the resulting toner decreases.

For a full color toner, a yellow colorant, a magenta colorant and a cyan colorant are generally used.

As the yellow colorant, there can be mentioned; compounds such as azo pigments, and condensed polycyclic pigments. Specific examples of the yellow colorant include pigments such as C.I. Pigment Yellow 3, 12, 13, 14, 15, 17, 62, 65, 73, 74, 83, 90, 93, 97, 120, 138, 155, 180, 181, 185 and 186.

As the magenta colorant, there can be mentioned; compounds such as azo pigments, and condensed polycyclic pigments. Specific examples of the magenta colorant include pigments such as C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209, 251, and C.I. Pigment Violet 19.

As the cyan colorant, there can be mentioned; cupper phthalocyanine compounds and their derivatives, anthraquinone compounds and the like. Specific examples of the cyan colorant include pigments such as C.I. Pigment Blue 2, 3, 6, 15, 15:1, 15:2, 15:3, 15:4, 16, 17, and 60.

An amount of the colorant is preferably 1 to 10 parts by weight per 100 parts by weight of the binder resin.

As the aforesaid parting agent, there can be mentioned; polyolefin waxes such as low molecular weight polyethylene, low molecular weight polypropylene and low molecular weight polybutylene; natural plant waxes such as candelilla, carnauba, rice, wood wax and jojoba; petroleum waxes such as paraffin, microcrystalline and petrolatum, as well as waxes modified therefrom; synthetic waxes such as Fischer-Tropsch wax; and polyfunctional ester compounds such as pentaerythritol tetramyristate, pentaerythritol tetrapalmitate, and dipentaerythritol hexamyristate.

These parting agents may be used alone or in a combination thereof.

Among these parting agents, synthetic waxes and multifunctional ester compounds are preferred. Furthermore, multifunctional ester compounds are more preferred, which show an endothermic peak temperature within the range preferably from 30° C. to 150° C., more preferably from 40° C. to 100° C., most preferably from 50° C. to 80° C., measured with a DSC curve by means of a differential scanning calorimeter at rising temperature, because a toner excellent in a balance between fixing property and peeling property during fixing is obtained. In particular, those having a molecular weight of 1,000 or more and soluble in styrene at 25° C. in amount of 5 parts by weight or more based on 100 parts by weight of styrene, and having an acid value of 10 mg KOH/g or less, are even more preferred, because it exhibits a distinguished effect in lowering a fixing temperature. As the multifunctional ester compounds, dipentaerythritol hexamyristate and pentaerythritol tetrapalmitate are particularly preferred. The endothermic peak temperature refer to values measured in accordance with ASTM D3418-82.

An amount of the parting agent is generally 3 to 20 parts by weight, preferably 5 to 15 parts by weight, per 100 parts by weight of the binder resin.

In the present invention, the toner preferably further comprises a charge control agent. As the charge control agent, charge control agents used in conventionally used toners can be employed without limitation. Among the charge control agents, a charge control resin is preferable, because charge control resins have high compatibility with binder resins, are colorless, and can provide a toner with a stable charging property even when it is used in high-speed continuous color printing. As the positive charge control resin, there be mentioned; quaternary ammonium (salt) group-containing copolymers produced in accordance with the descriptions of Japanese Patent Application Laid-Open Nos. Sho 63-60458, Hei 3-175456, Hei 3-243954, and Hei 11-15192. And, as the negative charge control resin, can be mentioned; sulfonic acid (salt) group-containing copolymers produced in accordance with the descriptions of Japanese Patent Application Laid-Open Nos. Hei 1-217464 and Hei 3-15858.

An amount of the monomer unit having the quaternary ammonium (salt) group or the sulfonic acid (salt) group contained in these copolymers is preferably 0.5 to 15% by weight, more preferably 1 to 10% by weight. If the content of the monomer unit is within this range, an amount of electrostatic charge of the toner is easy to control, and the generation of fog in printed image developed using the toner can be minimized.

Preferred as the charge control resin is that having a weight average molecular weight of 2,000 to 50,000, more preferably 4,000 to 40,000, most preferably 6,000 to 20,000. If the charge control agent has a weight average molecular weight less than 2,000, offset occurs on printed image; if the charge control agent has a weight average molecular weight more than 50,000, fixing ability of the resulting toner may deteriorate.

A glass transition temperature of the charge control resin is preferably from 40 to 80° C., more preferably from 45 to 75° C., most preferably from 45 to 70° C. If the glass transition temperature of the charge control resin is lower than 40° C., the shelf stability of the resulting toner may become deteriorated. If the glass transition temperature exceeds 80° C., fixing ability of the resulting toner may lower.

An amount of the charge control agent is generally 0.01 to 20 parts by weight, preferably 0.3 to 10 parts, per 100 parts by weight of the binder resin.

The colored resin particle may be a so-called core-shell structured (also called "capsule type") particle, in which the polymer for an inner layer (an core layer) of the particle is different from the binder resin for an outer layer (a shell layer) of the particle. The core-shell structure is preferred because the type can provide a favorable balance between lowering of the fixing temperature and prevention of aggregation of the toner during storage by covering the low softening point substance as the inner layer (core layer) with a substance having a higher softening point.

Generally, the core layer of the core-shell type particle is composed of the aforementioned binder resin and colorant, further a charge control resin and a parting agent if necessary, while the shell layer is composed of the binder resin alone.

The proportion by weight of the core layer to the shell layer of the core-shell type particle is not particularly limited, but is generally in the range from 80/20 to 99.9/0.1. By using the shell layer in this proportion, good shelf stability and good low temperature fixing ability of the toner can be fulfilled at the same time.

An average thickness of the shell layer of the core-shell type particle may be generally 0.001 to 0.1 μm, preferably 0.003 to 0.08 μm, more preferably 0.005 to 0.05 μm. If the thickness is too large, fixing ability of the resulting toner may decline. If it is too small, shelf stability of the resulting toner may decline. The core particle constituting the colored resin particle of the core-shell type particle does not necessarily have all of its surface covered with the shell layer. The surface of the core particle may partly be covered with the shell layer.

A diameter of the core particle and a thickness of the shell layer of the core-shell type particle can be measured by directly measuring the diameter and thickness of particles which are chosen randomly from photographs taken with an electron microscope, if possible. When it is difficult to observe both of the core and shell layer by an electron microscope, they can be calculated based on the diameter of the core particle and the amount of the monomer used for forming the shell layer at the time of producing the toner.

The colored resin particle constituting a toner according to the present invention has preferably a volume average particle diameter Dv of 3 to 15 μm, more preferably 4 to 12 μm, most preferably 4 to 12 μm. If the Dv is less than 3 μm, flowability of the resulting toner lowers, resulting in lowering transferring ability and thus causing blur or lowering image density. On the other hand, if the Dv is larger than 15 μm, resolution of printed image may be lowered.

The colored resin particles constituting a toner according to the present invention preferably has a ratio (Dv/Dp) of the volume average particle diameter (Dv) to a number average particle diameter (Dp) from 1.0 to 1.3, preferably 1.0 to 1.2. If the Dv/Dp exceeds 1.3, transferring ability of the resulting toner may be lowered, resulting in printed image having blur, lowered image density and resolution.

The volume average particle diameter and the number average particle diameter of the colored resin particles can be measured, for example, by use of Multisizer (Trade Name, manufactured by Beckman Coulter, Inc.).

The colored resin particle constituting a toner according to the present invention preferably has a sphericity from 1.0 to 1.3, more preferably 1.0 to 1.2. If the colored resin particle having a sphericity of 1.3 or more is used, fixing ability may deteriorate and flowability of the resulting toner may be lowered, resulting in blur on printed image easily.

In this description, the sphericity is represented by a value (Sc/Sr) which divided an area (Sc) of a circle having an absolute maximum diameter of an particle by a substantial projected area (Sr) of the particle. The sphericity is measured in the following manner.

The sphericity of each of silica fine particle and colored resin particle is measured such that each of the silica fine particle and colored resin particle is photographed with an electronic microscope. Then, each photograph is processed by an image processing and analysis apparatus LUZEX IID (Trade Name, manufactured by Nireco Corporation) under a condition in which an area ratio of the particles to an area of the frame is 2% at the maximum and the total number of the particles to be processed is 100. And, the sphericitiy is obtained by averaging the sphericities of 100 of the processed particle.

A producing method of the colored resin particle preferably includes, not limited to, any polymerization methods such as a suspension polymerization method, an emulsion polymerization method and the like. Especially, a suspension polymerization method is preferred.

Next, a method for producing the colored resin particles by the suspension polymerization method will be described in detail. The colored resin particle constituting a toner according to the present invention is produced such that a polymerizable monomer which is a raw material of the binder resin, a colorant, a charge control agent and other additives are dissolved or dispersed to obtain a polymerizable monomer composition, the obtained polymerizable monomer composition is polymerized in an aqueous dispersing medium containing a dispersion stabilizer in the presence of a polymerization initiator and then subjected to a filtration, washing, dehydration and drying.

In the present invention, the polymerizable monomer composition is preferably obtained in the following manner. A charge control resin used as a charge control agent is previously mixed with the colorant to prepare a charge control resin composition. Then, the charge control resin composition is added and mixed to the polymerizable monomer with the parting agent and the like. In such a case, an amount of the colorant is generally 10 to 200 parts by weight, more preferably 20 to 150 parts, per 100 parts of the charge control resin.

To prepare the charge control resin composition, the use of an organic solvent is preferable. By using the organic solvent, the charge control resin softens and is easily mixable with the pigment.

An amount of the organic solvent is generally 0 to 100 parts by weight, preferably 5 to 80 parts by weight, more preferably 10 to 60 parts by weight, per 100 parts by weight of the charge control resin. Within this range, an excellent balance between dispersibility and processability of the polymerizable monomer composition is obtained. The organic solvent may be added either at one time or dividedly upon observing the condition of the mixture.

The mixing of the charge control resin and the organic solvent may be performed using an equipment such as a roll, a kneader, a single screw extruder, a twin screw extruder, a Banbury mixer, a Buss co-kneader and the like. When an organic solvent is used, it is preferred to use a sealable mixing equipment for preventing leakage of the organic solvent to the outside.

Moreover, it is preferable to use a mixing equipment furnishing a torque meter because the torque meter enables to monitor and control the dispersibility with a level of the torque.

As a polymerizable monomer, there can be mentioned, for instance, a monovinyl monomer, a cross-linkable monomer and a macromonomer. These polymerizable monomers become the binder resin component after polymerization.

Specific examples of the monovinyl monomers include; aromatic vinyl monomers such as styrene, vinyltoluene and α-methylstyrene; acrylic ester monomers such as acrylic acid, methyl acrylate, ethyl acrylate, propyl acrylate, butyl acrulate, 2-ethylhexyl acrylate, cyclohexyl acrylate and isobonyl acrylylate; methacrylic ester monomers such as methacrylic acid, methyl methacrylate, ethyl methacrylate, propyl methacrylate, butyl methacrylate, 2-ethylhexyl methacrylate, cyclohexyl methacrylate and isobonyl methacrylylate; and mono olefin monomers such as ethylene, propylene and butylenes; and the like.

The monovinyl monomers may be used alone or in a combination thereof. Among the monovinyl monomers as mentioned above, it is preferable to use aromatic vinyl monomers alone, or to use aromatic vinyl monomers in a combination with acrylic ester monomers or methacrylic ester monomers The use of the crosslinkable monomer in a combination with the monovinyl monomer effectively improves hot offset resistance of the resulting toner. The crosslinkable monomer is a monomer having two or more vinyl groups. As specific examples of the crosslinkable monomer, there can be mentioned; divinylbenzene, divinylnaphthalene, ethlenglycol dimethacrylate, pentaerythritol triallyl ether and trimethylolpropane triacrylate. These crosslinkable monomers may be used alone or in a combination thereof. An amount of the crosslinkable monomer is generally 10 parts by weight or less, preferably 0.1 to 2 parts by weight, per 100 parts by weight of the monovinyl monomer.

It is preferable to use a macromonomer together with the monovinyl monomer because this use provides a satisfactory balance between shelf stability and fixing ability at a low temperature. The macromonomer is an oligomer or polymer having a polymerizable carbon-carbon unsaturated double bond at its molecular chain terminal and a number average molecular weight of generally from 1,000 to 30,000.

The macromonomer is preferably the one which gives a polymer having a glass transition temperature higher than that of a polymer obtained by polymerizing the above-mentioned monovinyl monomer alone.

An amount of the macromonomer used is generally 0.01 to 10 parts by weight, preferably 0.03 to 5 parts by weight, more preferably 0.05 to 1 part by weight, per 100 parts by weight of the monovinyl monomer.

As examples of the polymerization initiator, there can be mentioned; persulfates such as potassium persulfate and ammonium persulfate; azo compounds such as 4,4'-azobis-(4-cyanovaleric acid), 2,2'-azobis-(2-methyl-N-(2-hydroxyethyl))propionamide, 2,2'-azobis-(2-amidinopropane)dihydrochloride, 2,2'-azobis-(2,4-dimethyl valeronitrile) and 2,2'-azobis-isobutyronitrile; and peroxides such as di-t-butyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, and t-butyl peroxyisobutyrate. Redox initiators, composed of combinations of these polymerization initiators with a reducing agent, may also be used.

An amount of the polymerization initiator used in the polymerization of the polymerizable monomer is preferably 0.1 to 20 parts by weight, more preferably 0.3 to 15 parts by weight, most preferably 0.5 to 10 parts by weight, per 100 parts by weight of the polymerizable monomer. The polymerization initiator may be added to the polymerizable monomer composition in advance or may be added to an aqueous dispersion medium after forming droplets depending on conditions.

Moreover, at the time of polymerization, a dispersion stabilizer may be added to the reaction system. As the dispersion stabilizer, there can be mentioned; a metallic compound such as sulfates such as barium sulfate and calcium sulfate; carbonates such as barium carbonate, calcium carbonate and magnesium carbonate; phosphates such as calcium phosphate; and metal oxides such as aluminum oxide and titanium oxide; and besides, metallic hydroxides such as aluminum hydroxide, magnesium hydrate and ferric hydroxide; water-soluble polymers such as polyvinyl alcohol, methyl cellulose and gelatin; anionic surfactants; nonionic surfactants; and amphoteric surfactants. The aforesaid dispersion stabilizer may be used alone or in combination of two kinds thereof.

Among the above dispersion stabilizers, a dispersion stabilizer containing colloid of the metallic compound, especially a hardly water-soluble inorganic hydroxide is preferred, since it can narrow the particle size distribution of a polymer particles; the remaining amount of the dispersion stabilizer after washing is small; and it can sharply reproduce images.

The colloid of the hardly water-soluble metallic hydroxide preferably has a particle diameter (Dp50) of 0.5 μm or less, the particle diameter (Dp50) representing a particle diameter at which a volume cumulative total calculated from small particle diameter side in a number particle diameter distribution is 50%, and a particle diameter (Dp90) of 1 μm or less, the particle diameter (Dp90) representing a particle diameter at which the mentioned volume cumulative total calculated from small particle diameter side is 90%. If the particle diameter of the colloid is too great, the stability of the polymerization may be broken, and the stability of the resulting toner may be deteriorated.

An amount of the above described dispersion stabilizer is preferably 0.1 to 20 parts by weight relative to 100 parts by weight of the polymerizable monomer. If the amount of the dispersion stabilizer is lower than 0.1 parts by weight, it is difficult to achieve sufficient polymerization, so that polymerization aggregate are easy to be formed. On the other hand, if the amount exceeds 20 parts by weight, the viscosity of the polymer dispersion becomes too high, making it difficult to stir the dispersion.

Further, upon polymerization, a molecular weight modifier is preferably used. As the molecular weight modifier, there can be mentioned; mercaptans such as t-dodecyl mercaptan, n-dodecyl mercaptan, n-octyl mercaptan and 2,2,4,6,6-pentamethylheptane-4-thiol and the like. The molecular weight modifier may be added before or during polymerization reaction. An amount of the molecular weight modifier is preferably 0.01 to 10 parts by weight, more preferably 0.1 to 5 parts by weight, per 100 parts by weight of the polymerizable monomer.

A method for producing the core-shell type colored resin particles is not limited, and these colored resin particles can be produced by a publicly known method. For example, a method such as spray-drying method, interfacial reaction method, in-situ polymerization method, or phase separation method may be named. Specifically, colored resin particles obtained by pulverization, polymerization, association or phase inversion emulsification as core particles are covered with a shell layer to prepare core-shell type colored resin particles. Of these methods, the in-situ polymerization method and phase-separation method are preferable because of their efficient productivity.

The method for producing the core-shell type colored resin particles using the in-situ polymerization process is described in detail below.

A polymerizable monomer to form a shell (polymerizable monomer for shell) and a polymerization initiator are added to an aqueous dispersion medium including core particles dispersed therein, and the mixture is polymerized to obtain the core-shell type colored resin particles.

As specific examples of the process for forming the shell, there can be mentioned; a process comprising adding a polymerizable monomer for a shell to a reaction system of a polymerization reaction which has been conducted for preparing core particles to continuously conduct polymerization; and a process comprising introducing core particles prepared in a different reaction system and adding a polymerizable monomer for a shell thereto to conduct polymerization.

The polymerizable monomer for shell may be provided into the reaction system at one time, or may be provided continuously or dividedly using a pump such as a plunger pump.

As the polymerizable monomer for shell, monomers capable of forming a polymer having a glass transition temperature of higher than 80° C. by polymerization, such as styrene, acrylonitrile and methyl methacrylate, may be used alone or in a combination thereof.

When the polymerizable monomer for shell is added to the reaction system, a water-soluble polymerization initiator is preferably, because this addition makes it easy to obtain the core-shell type colored toner particles. It is speculated that when the water-soluble polymerization initiator is added during addition of the polymerizable monomer for shell, the water-soluble polymerization initiator migrates to a zone surrounding the surface of the core particle, the zone where the polymerizable monomer for shell has moved, so that a polymer (shell) is easily formable on the surface of the core particle.

As the water-soluble polymerization initiator; there can be mentioned; persulfates such as potassium persulfate, and ammonium persulfate; azo compounds such as 2,2'-azobis-(2-methyl-N-(2-hydroxyethyl)propionamide), and 2,2'-azobis-(2-methyl-N-(1,1'-bis(hydroxymethyl)-2-hydroxyethyl) propionamide. An amount of the water-soluble polymerization initiator is generally 0.1 to 30 parts by weight, preferably 1 to 20 parts by weight, per 100 parts by weight of the polymerizable monomer for shell.

A temperature during polymerization is preferably 50° C. or higher, more preferably 60 to 95° C. A polymerization reaction time is preferably 1 to 20 hours, more preferably 2 to 10 hours. After completion of the polymerization, a procedure comprising filtration, washing, dehydration and drying is preferably repeated several times, as desired, in accordance with the conventional methods.

In the aqueous dispersion of the colored resin particles obtained by the polymerization, if an inorganic compound such as inorganic hydroxide is used as the dispersion stabilizer, the dispersion stabilizer is preferably dissolved in water and removed by adding acid or alkali. If colloid of a hardly water-soluble inorganic hydroxide is used as the dispersion stabilizer, it is preferable to add acid so that pH of the aqueous dispersion is pH6.5 or lower. As the acid to be added, an inorganic acid such as sulfuric acid, hydrochloric acid or nitric acid; or an organic acid such as formic acid or acetic acid; can be used. Sulfuric acid is particularly preferable because it has a high efficiency of its removal and its burden on production facilities is light.

There is no limitation on the method of filtering toner particles from the aqueous dispersion medium for dehydration. For example, centrifugal filtration, vacuum filtration or pressurized filtration can be named. Of these methods, centrifugal filtration is preferable.

The toner according to the present invention is obtained by mixing the toner particles and the external additive and, if desired, other fine particles by means of a high speed stirrer such as a Henschel mixer.

EXAMPLES

The present invention is hereinafter to be described more specifically by the following examples. Such examples, however, are not to be construed as limiting in any way the scope of the present invention. All designations of "part" or "parts" and "%" used in the following examples mean part or parts by weight and wt. % unless expressly noted.

(1) Average Particle Diameter and Particle Diameter Distribution of Colored Resin Particle A volume average particle diameter (Dv) and a particle diameter distribution, i.e., a ratio (Dv/Dp) of the volume average particle diameter to a number average particle diameter (Dp), of the colored resin particle was measured by means of a particle diameter measuring device ("MULTISIZER", Trade Name, manufactured by Beckman Coulter Inc.). The measurement by the Multisizer was conducted under the following conditions:

Aperture diameter: 100 μm;

Medium: Isothone II;

Concentration: 10% and

Number of particles measured: 100,000 particles.

(2) Average Particle Diameter and Particle Diameter Distribution of External Additive 0.5 g of silica fine particle was poured in a 100 ml beaker, and a few drops of surfactant were dropped therein and 50 ml of ion-exchanged water was added therein. Then, after the mixture was dispersed using an ultrasonic homogenizer US-150T (Trade Name) for 5 minutes, the silica fine particle was measured in a volume average particle diameter using MICROTRAC UPA150T (Trade Name, manufactured by NIKKISO Co., Ltd.,).

And, a number average particle diameter of the conductive inorganic particle was measured in such a manner that each of the particles was photographed using an electronic microscope. Then, the photograph was processed using an image processing and analysis apparatus LUZEX IID (Trade Name, manufactured by Nireco Corporation), under a condition in which an area ratio of the particles to an area of the frame is 2% at the maximum and the total number of the particles to be processed is 100, so as to calculate a circle equivalent diameter of the particles. Then, the obtained particle diameters were averaged.

(3) Sphericity

The sphericity was represented by a value (Sc/Sr) which divided an area (Sc) of a circle having an absolute maximum diameter of each of the colored resin particle and silica fine particle (A) by a substantial projected area (Sr) of each of the particles. The sphericity was measured in the following manner. Each of the silica fine particle and colored resin particle was photographed with an electronic microscope. Then, each photograph was processed by an image processing and analysis apparatus LUZEX IID (Trade Name, manufactured by Nireco Corporation), under a condition in which an area ratio of the particles to an area of the frame is 2% at the maximum and the total number of the particles to be processed is 100. And, the sphericity was obtained by averaging the spheroidicities of 100 of the processed particle.

(4) A Degree of Hydrophobicity

A degree of hydrophobicity of each of the silica fine particle and conductive inorganic particle was measured by a methanol test.

0.2 g of each of the silica fine particle or conductive inorganic particle was poured in a 500 ml beaker, 50 ml of pure water was added thereto, and methanol was added under the liquid level under stirring using a magnetic stirrer. At an end point at which fine particles were not observed on the liquid level, the degree of hydrophobic property was calculated using the following equation:

$$\text{a degree of hydrophobic property}(\%)=(x/(50+X))\times 100,$$

wherein X means an amount (ml) of methanol used.

(5) Appearance Bulk Density

The silica fine particles to be measured were gradually added to a 100 ml measuring cylinder weighted previously without imparting vibration. When the volume of the silica fine particle added was reached to 100 ml, the measuring cylinder including the silica fine particle was measured in weight. Then, a difference between the weights before and after adding the silica fine particles was calculated, and the difference was multiplied by 10 to be an appearance bulk density (g/l) of the silica fine particle (A).

(6) Fog

Copy papers were set in a commercially available non-magnetic-one-component developing type printer (600 dpi, 20-sheet/min machine), and the toner was put in a developing device of the printer. The printer was laid still for a day and a night under the (N/N) environment of a temperature of 23° C. and a humidity of 50%. Then, printing was continuously performed at an image density of 5%. And, at the beginning (after 100 papers printing) and at 20,000 papers printing, the printing was stopped during printing a solid white image and the toner developed a non-image on the photoconductive member after developing was stripped off and collected by sticking with an adhesive tape (SCOTCH MENDING TAPE 810-3-18, Trade Name, manufactured by Sumitomo 3M Limited). Then the adhesive tape was stuck on a new sheet of paper to measure whiteness (B) using a whiteness meter (manufactured by Nippon Denshoku Industries Co., Ltd.). At the same time, as a reference, an unused adhesive tape was stuck on the same new sheet of paper to measure whiteness (A), and the difference (A-B) in the whitenesses A and B was set to the fog (%). The smaller the difference was, the smaller the fog was. The samples having no numeric number in table could not be evaluated due to large fog.

(7) Resolution

Using the printer used in (6), the toner was left standing over a day and night under the (N/N) environment of a temperature of 23° C. and a humidity of 50%. Then, printing was continuously performed at an image density of 5%. At 20,000 papers printing, line images containing a 1×1 dotlines and a 2×2 dotlines were printed, and the printed images were observed using an optical microscope. Whether or not the printed image was reproduced was evaluated according to the following standards. The samples having no results in the table could not be evaluated due to large fog.

good: 1×1 dotlines being reproducible.

fair: 1×1 dotlines being not reproducible and 2×2 dotlines being reproducible.

poor: 2×2 dotlines being not reproducible.

(8) Cleaning Property

After the toner was put in the developing device of the printer used in (6) and left standing over a day and a night under the (N/N) environment of a temperature of 23° C. and a humidity of 50%, printing was continuously performed at an image density of 5% until 20,000 papers were printed. Every 1,000 printing, the photoconductive member and the charging roll were observed in order to count the number of papers at which cleaning failure was generated thereon. In the table, "more than 20,000" means no cleaning failure at 20,000 printing.

(9) Filming

Printing papers were put in the printer used in (6), and the toner was put in the developing device of the printer and left standing over a day and a night under the (N/N) environment of a temperature of 23° C. and a humidity of 50%. Then, halftone printing was performed at an image density of 5%. Every 500 printing, printed image were evaluated in order to count the maximum number of papers which could be printed without blurred filming on the halftone printed image. In the table, "more than 20,000" means no filming at 20,000 printing.

Production Example 1

Preparation of Charge Control Resin Composition 100 parts of charge control resin (a weight average molecular weight: 12,000, glass transition temperature: 67° C. obtained by polymerizing 82% of styrene, 11% of 7% of N,N-diethyl-N-methyl-(2-methacryloxy)ethylammonium-P-toluenesulfonate was dispersed into 24 parts of methyl ethyl ketone and 6 parts of methanol. And, the dispersion was mixed by rolls under cooling. After the resulting mixture was winded on the roll, 100 parts of magenta pigment ("C.I. PIGMENT RED 122", Trade Name, manufactured by Clariant Co.) was gradually added and stirred for one hour to prepare a charge control resin composition. During this period, the clearance between the rolls was initially 1 mm, broadened gradually, to finally to 3 mm, and an organic solvent (a solvent mixture of methyl ethyl ketone/methanol=4/1) was added occasionally according to mixing and kneading condition of the charge control resin composition. After the stirring, the organic solvent added was removed under reduced pressure.

Example 1

Comparative Examples 1 to 4

87 parts of styrene, 13 parts of n-butylacrylate, 0.5 parts of divinylbenzene, 0.25 parts of polymethacrylate ester macromonomer ("AA6", Trade Name, Tg: 94° C., manufactured by Toagosei CO., LTD.), 10 parts of the charge control resin composition obtained by the production example 1, 10 parts of pentaerythritol tetrastearate and 1.5 parts of t-dodecyl mercaptan were dispersed using a beadmill at a room temperature to give a homogeneous mixture. While stirring the mixture, 5 parts of polymerization initiator "PERBUTYL 0" (Trade Name, manufactured by NOF CORPORATION) was added thereto, and the stirring was continuously performed until the dispersed uniformly, thereby to give a polymerizable monomer composition.

At the same time, a n aqueous solution containing 6.9 parts of sodium hydroxide (alkali metal hydroxide) dissolved in 50 parts of ion-exchanged water was gradually added to an aqueous solution containing 9.8 parts of magnesium chloride (water-soluble polyvalent metallic salt) dissolved in 250 parts of ion-exchanged water, with stirring, to prepare a magnesium hydroxide colloidal dispersion (colloid of hardly water-soluble metal hydroxide). Then, the polymerizable monomer composition was added to the colloid dispersion, and the mixture was stirred and mixed at 12,000 rpm under high shearing force using a TK homomixer, to form fine droplets of the polymerizable monomer composition. The thus-formed aqueous dispersion containing the polymerizable monomer composition mixture was charged into a reactor equipped with an agitating blade to initiate a polymerization reaction at 90° C. At the time the conversion of the monomer into a polymer reached almost 100%, 0.8 parts of methyl methacrylate as a monomer for a shell was added and 0.1 of water-soluble polymerization initiator ("VA-086", Trade Name, manufactured by Wako Pure Chemical Industries, Ltd.,) dissolved in 50 parts of ion-exchanged water was added. Then, the mixture was polymerized for 4 hours and then cooled, thereby to prepare a aqueous dispersion of core-shell type polymer particles.

While stirring the aqueous dispersion of polymer particle thus prepared, the pH of the system was adjusted to 4 or lower using sulfuric acid to be subjected to acid washing. After the aqueous dispersion was filtered to separate water, 500 parts of ion-exchanged water was newly added thereto to form a slurry again to subject to water washing. Thereafter, the dehydration and water washing were repeatedly performed several times, and solids contained in the solution was separated by filtration and dried at 45° C. for two days and night using a dryer to prepare colored resin particles. The colored resin particles thus obtained had a volume average particle diameter (Dv) of 7.8 μm, a particle diameter distribution (Dv/Dp) of 1.25 and a spheridicity of 1.15.

To 100 parts of the colored resin particles obtained above, external additives shown in the table 1 were added in an amount (an amount to 100 parts of the colored resin particle) shown in table 1, respectively, and mixed for 3 minutes at 1,400 rpm using HENSCHEL MIXER to prepare toner.

Property of the toner and image quality of a printed image developed using the toner were evaluated according to the above-mentioned manner. The results were shown in table 1.

In the table 1, the following external additives were used.

Small Diameter Inorganic Particle:

Silica fine particle subjected to a hydrophobicitizing treatment with cyclic sirazan and having a primary particle diameter of 7 nm and a degree of hydrophobicity of 74% (TG820F, Trade Name, manufactured by CABOT JAPAN K.K)

Silica Fine Particle (A):

100 parts of a powder mixture composed of 0.8 mole of silicon metal powder (an average particle diameter: 10 μm, a maximum particle diameter: 100 μm) to 1.0 mole of $SiO_2$ of silica powder (an average particle diameter: 2 μm, a maximum particle diameter: 60 μm) was mixed to 50 parts of pure water, and the mixture was charged in a thin vessel and then continuously supplied in a bath to an electric furnace of 2000° C. And, hydrogen gas was induced into the electric furnace from the same direction as the supply direction of the powder mixture, and the hydrogen gas and another generated gas were drawn using an exhaust blower attached at an upper portion opposite to the hydrogen gas including direction. In addition, 400 $Nm^3$/hr of air contacted the powder mixture to collect silica fine particles by bag filter under cooling. The silica fine particle thus collected had a particle diameter of 0.1 μm.

The silica fine particles were classified using a pneumatic separator. The silica fine particle after the classification had a Dv50/Dv10 of 2.54, an average particle diameter of 0.2 μm and a spheriodicity of 1.12.

Amino modified silicon oil ("BY16-872", Trade, Name, manufactured by Toray Silicone Co., Ltd.) diluted with alcohol was dropped to the silica fine particles such that the amount of the amino modified silicon oil was 8% by weight to the amount of the silica fine particle, and the mixture was heated at 70° C. for 30 minutes under strongly stirring. Then, the solvent was removed from the mixture at 140° C., and the mixture was further heated at 210° C. for 4 hours under strongly stirring. Thus, a hydrophobicitizing-treated silica fine particle A was obtained. The silica fine particle A has a degree of hydrophobicity of 80% and an appearance bulk density of 110 g/l.

Silica Fine Particle B:

Tetra methoxy silane purified by distillation was heated and then bubbled with nitrogen gas, and the tetra methoxy silane was induced to an oxyhydrogen flame burner with nitrogen gas stream to decompose by combustion in the oxyhydrogen flame. An amount of the supplied tetra methoxy silane was 1268 g/hr, an amount of the supplied oxygen gas was 2.8 $Nm^3$/hr, an amount of the supplied hydrogen gas was 2.0 $Nm^3$/hr and an amount of the supplied nitrogen gas was 0.59 $Nm^3$/hr. The produced spherical silica was collected by a bag filter. The spherical silica had a particle diameter of 0.12 μm. Because the spherical silica particles contained large amount of finer particles, the finer particles were removed using a pneumatic separator, thereby to obtain a silica fine particles B having a Dv50/Dv10 of 1.65, an average particle diameter of 0.15 μm and a sphericity of 1.10. Then, in the same manner as the silica fine particle A, the silica fine particle B was subjected to a hydrophobicitizing treatment. The obtained silica fine particle B had a degree of hydrophobicity of 70% and an appearance bulk density of 300 g/l.

Silica Fine Particle C:

Ammonia water was added to ethanol and stirred at 20° C., and tetra methoxy silane was dropped to the mixture for 60 minutes to react thereto. After dropping, the mixture was continuously stirred at 20° C. for 5 hours to obtain a sol suspension of silica. Then, the sol suspension thus obtained was heated to remove ethanol, and further heated at 120° C. to remove water. The obtained silica fine particle had an average particle diameter of 0.12 μm. Because the silica particles contained large amount of finer particles, the finer particles were removed using a pneumatic separator, thereby to obtain a silica fine particles C having a Dv50/Dv10 of 1.69, an average particle diameter of 0.16 μm and a sphericity of 1.07. Then, in the same manner as the silica fine particle A, the silica fine particle C was subjected to a hydrophobicitizing treatment. The obtained silica fine particle C had a degree of hydrophobicity of 80% and an appearance bulk density of 510 g/l.

Silica Fine Particle D:

In the same manner as the preparation of the silica fine particle C except that the reaction temperature was lowered to 10° C. from 20° C., a silica fine particle was obtained. And, the silica fine particle was subjected to a hydrophobicitizing treatment in the same manner as the silica fine particle A. The obtained silica fine particle D had a Dv50/Dv10 of 1.27, an average particle diameter of 0.19 μm and a sphericity of 1.08. The obtained silica fine particle D had a degree of hydrophobicity of 60% and an appearance bulk density of 640 g/l.

Silica Fine Particle E:

AEROSIL 50 (Trade Name, manufactured by Nippon Aerosil co., ltd.) was subjected to a hydrophobicitizing treatment in the same manner as the silica fine particle A. The obtained silica fine particle E had a Dv50/Dv10 of 1.32, an average particle diameter of 0.19 μm and a sphericity of 1.24. The obtained silica fine particle E had a degree of hydrophobicity of 75% and an appearance bulk density of 50 g/l.

Conductive Inorganic Fine Particle:

Conductive titanium oxide ("EC300", Trade Name, manufactured by Titan Kogyo K.K) doped with tin and antimony and having a degree of hydrophobicity of 0% and a number average particle diameter of 0.08 μm.

TABLE 1

| | Ex. 1 | Com. Ex. 1 | Com. Ex. 2 | Com. Ex. 3 | Com. Ex. 4 |
|---|---|---|---|---|---|
| External Additive | | | | | |
| small diameter inorganic fine particle | 0.5 | 0.5 | 0.5 | 0.5 | 0.5 |
| silica fine particle A | 1.0 | | | | |
| silica fine particle B | | 1.0 | | | |
| silica fine particle C | | | 1.0 | | |
| silica fine particle D | | | | 1.0 | |
| silica fine particle E | | | | | 1.0 |
| Conductive inorganic fine particle | 0.3 | 0.3 | 0.3 | 0.3 | 0.3 |
| Properties of toner | | | | | |
| Volume average particle diameter (μm) | 7.8 | 7.8 | 7.8 | 7.8 | 7.8 |
| Particle diameter distribution (Dv/Dp) | 1.25 | 1.25 | 1.25 | 1.25 | 1.25 |
| sphericity | 1.15 | 1.15 | 1.15 | 1.15 | 1.15 |
| Image properties | | | | | |
| Fog | 0.5 | — | 1.2 | 0.8 | — |
| Resolusion | good | — | fair | fair | — |
| Cleaning property | 20,000 or more | 15,000 | 20,000 or more | 20,000 or more | 5,000 |
| Filming | 20,000 or more | 13,000 | 10,000 | 5,000 | 15,000 |

The results of the evaluation of the toners shown in the table 1 shows the following facts.

The toners of the Comparative Examples 1 to 4, in which silica fine particles each having Dv50/Dv10 outside of the scope of the present invention were used as external additives, shows fog on the printed image, less solution, and cleaning failure or filming.

On the contrary, the toner of the Example 1 according to the present invention causes less fog on the printed image, good resolution, good cleaning properties and less filming.

INDUSTRIAL APPLICABILITY

According to the present invention, there are provided toners causing less fog, and excellent resolution on the printed image, excellent in cleaning property, and cause less filming.

What is claimed is:

1. A method of producing a toner, comprising mixing colored resin particles and an external additive with a high speed stirrer, wherein the external additive includes silica fine particles (A) having a Dv50/Dv10 of 1.8 or more, in which Dv10 and Dv50 represent particle diameters at which cumulative volumes reach 10% and 50%, respectively, when counted from the smaller particle diameter side, a volume average particle diameter of 0.1 to 1.0 μm, and a sphericity of 1 to 1.3, and silica fine particles (B) having a volume average particle diameter of 7 to 30 nm;

the amount of the silica fine particles (A) is 0.3 to 5 parts by weight based on 100 parts by weight of the colored resin particles;

the amount of the silica fine particles (B) is 0.1 to 3 parts by weight based on 100 parts by weight of the colored resin particles; and wherein the silica fine particle (A) is nonconductive.

2. The method according to claim 1, wherein the silica fine particles (A) have a bulk density of 50 to 250 g/L.

3. The method according to claim 1, wherein the silica fine particles (A) are produced by a melting method.

4. The method according to claim 1, wherein the external additive further includes conductive inorganic fine particles (C) having a number average particle diameter of 0.01 to 2 um.

* * * * *